US005132646A

United States Patent [19]

Faxon

[11] Patent Number: 5,132,646

[45] Date of Patent: Jul. 21, 1992

[54] COAXIAL PLANAR MAGIC TEE

[76] Inventor: Terry A. Faxon, 8 Butler St., Newburyport, Mass. 01950

[21] Appl. No.: 178,294

[22] Filed: Apr. 6, 1988

[51] Int. Cl.[5] ..... H01P 5/20

[52] U.S. Cl. ..... 333/121; 333/123

[58] Field of Search ..... 333/117, 121, 122, 123

[56] References Cited

U.S. PATENT DOCUMENTS

| | | | |
|---|---|---|---|
| 2,735,985 | 2/1956 | Thomas, Jr. | 333/117 X |
| 2,792,493 | 5/1957 | Duckett et al. | 333/122 X |
| 3,068,429 | 12/1962 | Stracca | 333/121 |
| 3,281,720 | 10/1966 | Cohn | 333/121 |
| 3,364,444 | 1/1968 | Cappucci | 333/121 |
| 3,739,302 | 6/1973 | McManus | 333/1.1 |

FOREIGN PATENT DOCUMENTS

| | | | |
|---|---|---|---|
| 9723318 | 7/1959 | Fed. Rep. of Germany | 333/122 |

*Primary Examiner*—Paul Gensler

*Attorney, Agent, or Firm*—Donald Brown

[57] ABSTRACT

A Coaxial Planar Magic Tee in which the tee portion is positioned inside a ridged waveguide. When used in one application the device also includes a load to dissipate power in an arm thereof.

3 Claims, 4 Drawing Sheets

COAXIAL PLANAR MAGIC TEE

BACKGROUND OF THE DISCLOSURE

This invention is directed to microwave devices for transferring power between one input and two outputs or vice versa.

Isolated coaxial four port devices can take two forms: split tee devices as described by Parad and Moynihan (IEEE MTT Transactions, Jan. 1965) and coupled line devices. The split tee device offers benefit in power division equality over the coupled line device. In general, the split tee device is inferior at power handling due to the fact that, one or more load resistors, are inefficient in their ability to dissipate the heat generated within themselves due to reflected power. Even the coupled line device has power and size shortcomings due to the fact the coaxial loads are large and inefficient.

The magic tee disclosed herein, unlike the aforementioned devices, has the capability of being able to handle more power than the coaxial transmission lines and connectors leading into and out of it.

This magic tee device of the invention has many applications. One use is an isolated power divider. Since the tee of this disclosure is a split tee device, it has exceptional amplitude tracking properties between ports. It is an isolated device so that it offers isolation between output ports. A common application is for a high power source to transmit its output to two antennas. Isolation between output ports insures undisturbed power flow to each of the antennas if the other is interrupted.

Another use of the magic tee device of this invention is a combiner. Here two equal in phase signals are combined to form a common output. If the signals are not in phase or unequal, the isolation property protects each transmitting sources from the other.

In both these applications the magic tee device of this invention works at a power level well in excess of present techniques.

SUMMARY OF THE DISCLOSURE

The planar magic tee of this invention is a split tee divider, where the coaxial input line splits equally between two outputs in a tee structure. The input coaxial center conductor is placed along the central axis between two ridges of a double ridge waveguide, e.g. of aluminum. At the tee junction, the center conductor, e.g. metal such as berrylium copper, splits into two output lines which exit the waveguide structure through the ridges orthogonal to the broadwall of the waveguide. The waveguide continues along beyond the split center conductor where it terminates in a high power load. When the signal enters along the coaxial input, the signal is in the TEM mode. It does not excite any fields in the waveguide structure due to the TEM and $TE_{10}$ fields being orthogonal to each other. At the junction, each output turns to a position perpendicular to the input so that each will generate a $TE_{10}$ field generated in the waveguide structure. However, owing to symmetry, the fields set up by the output lines in the waveguide are equal and opposite and therefore cancel resulting in no net $TE_{10}$ field generated in the waveguide and thus no energy is sent to the load.

Power which is reflected back from the outputs will in general be in any phase or amplitude. In the case where only one output is reflecting energy, power is then split equally between the input port and the load port. The field set up inside the waveguide is a $TE_{10}$ field which will propagate to the load where it is absorbed.

If both output ports reflect equally but out of phase, then all the reflected energy is directed back into the load. The output ports are isolated from each other and therefore get no power.

If the device is used as a combiner, the two input ports sum to produce in phase and out of phase fields. The in phase energy is directed to the coaxial output. The out of phase energy is directed to the waveguide load where it is dissipated as heat.

The planar magic tee of the invention is capable of broadband operation with the limit to bandwidth being the ability of the waveguide section to support the frequency band as a $TE_{10}$ mode.

As in any magic tee, there is a tradeoff between bandwidth and performance. In order to optimize performance over certain bandwidths, matching devices are used. The input coaxial line is preferably stepped in diameter to create a transformer between the input line and the two parallel output lines. The waveguide transformer dimensions in the load section are preferably sized to match the series connection of coaxial output lines. The length of input waveguide section which surrounds the input coax is preferably adjusted to provide reactive tuning for the junction. In practice, this length is usually chosen to be a quarter wavelength long at center frequency.

DETAILED DESCRIPTION OF THE DRAWINGS

Figure 1:
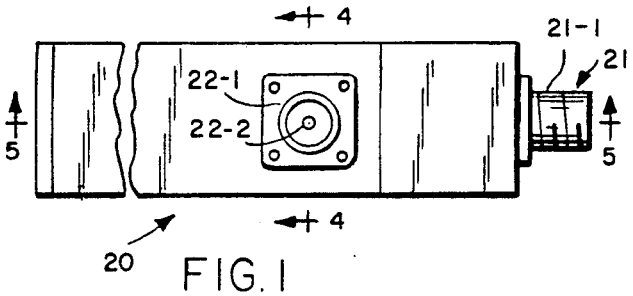
FIG. 1 is a side plan view of the preferred embodiment of the magic tee device of this invention from a perspective showing one input port and one of two output ports.
Figure 2:
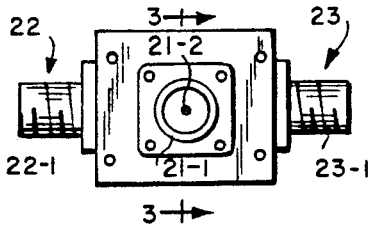
FIG. 2 is a front end view of the device of the invention.
Figure 3:
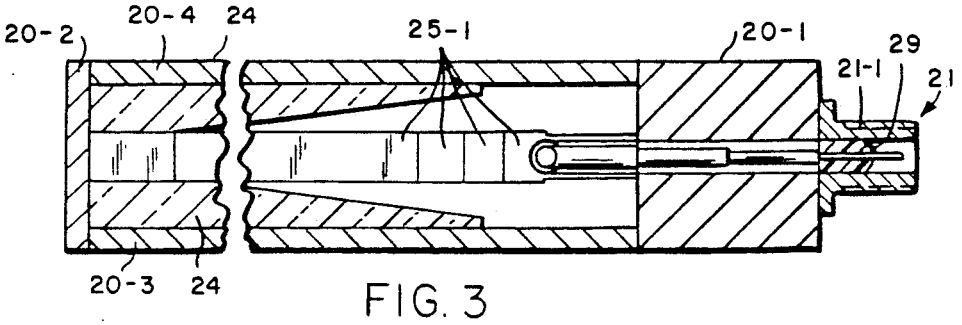
FIG. 3 is a sectional view taken along line 3—3 in FIG. 2.
Figure 5:
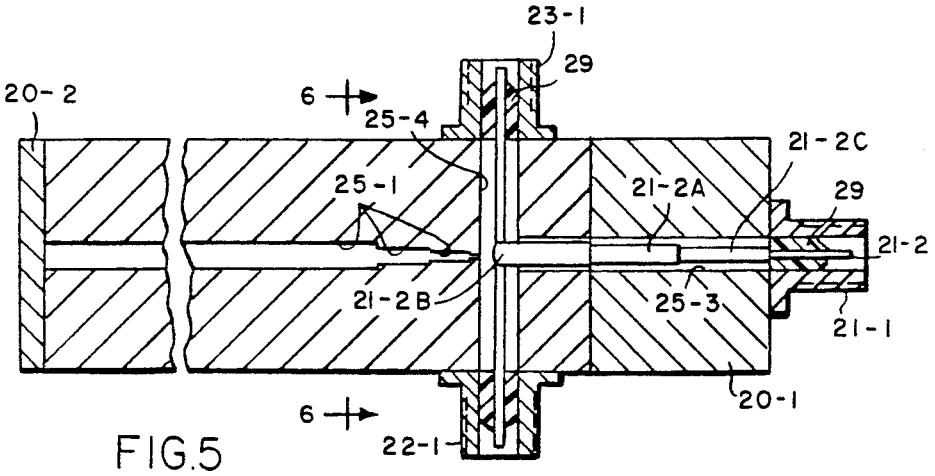
FIG. 5 is a sectional view taken along line 5—5 of FIG. 1.
Figure 4:
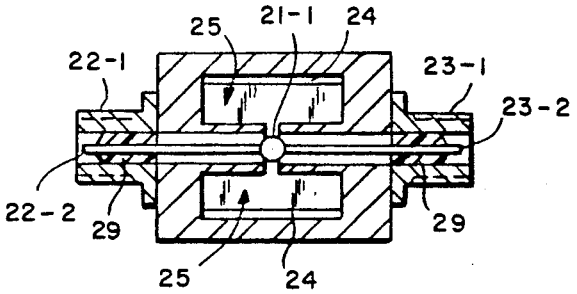
FIG. 4 is a sectional view taken along line 4—4 in FIG. 1.
Figure 6:
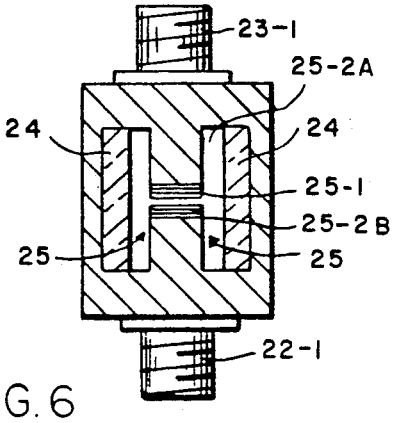
FIG. 6 is a sectional view taken along line 6—6 of FIG. 5.
Figure 7:
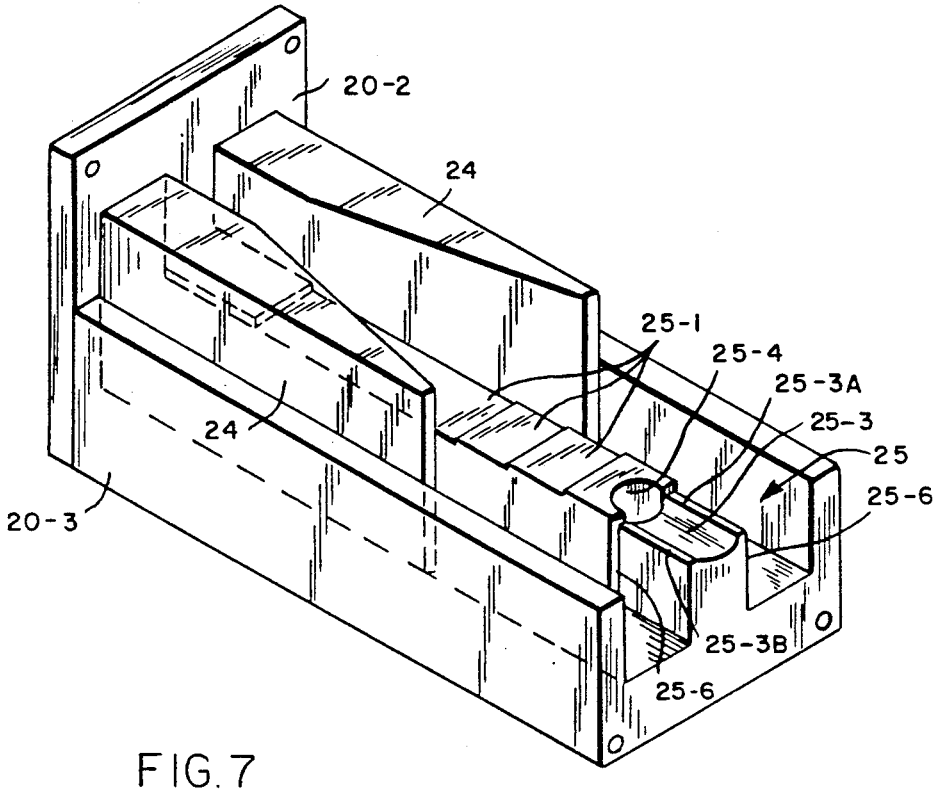
FIG. 7 is an enlarged isometric view showing one side half of the wave guide open to show the load.
Figure 8:
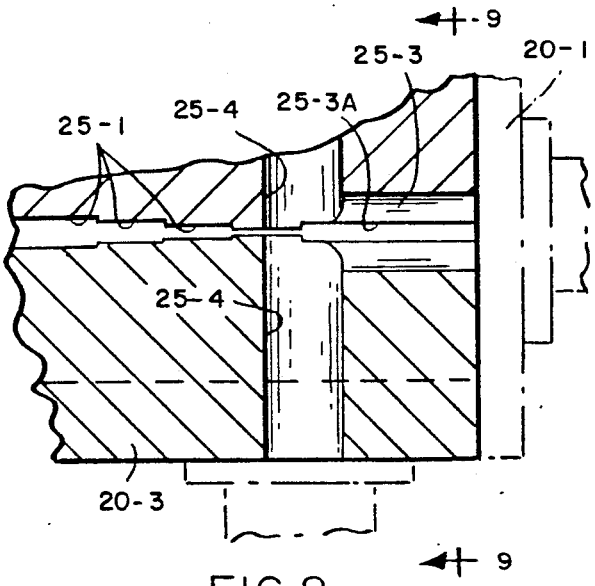
FIG. 8 is an enlarged partial sectional view similar to FIG. 5 showing the ridged waveguide.
Figure 9:
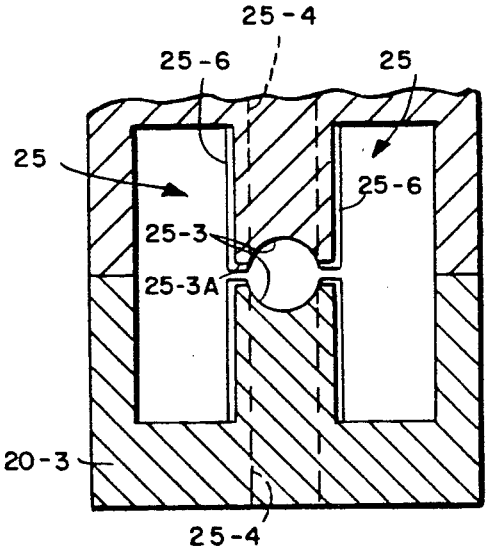
FIG. 9 is a sectional view taken along line 9—9 in FIG. 8.

Reference shall now be had to FIGS. 1 to 12 for a description of the preferred embodiment of the invention.

The magic tee device is shown at 20 and includes coaxial input port 21 and two output ports 22 and 23. The tee 20 includes front cover 20-1, rear cover 20-2, and center sections 20-3 and 20-4. The input (common) connector is shown at 21-1 and output colinear connectors are shown at 22-1 and 23-1. The input center cylindrical conductor (hollow at end, see FIG. 12, since it is a female connector) is shown at 21-2 and includes three transistions 21-2A, 21-2B and 21-2C which act as a step transformers. It should be understood that a male configuration connector could be used in place of the female type connector. The waveguide load is shown at 24 and ridged interior waveguide is shown at 25 and includes ridges 25-2A and 25-2B and three impedance transformer steps in the interior waveguide are shown at 25-1 to improve impedance matching. The output center cylindrical conductors are shown at 22-2 and 23-2 and the output connectors are shown respectively at 22-1 and 23-1. Dielectric supports for conductors 21-2 22-2 and 23-2 are shown at 29.

The conductors 21-2, 22-2, and 23-2 are positioned in bores 25-3 and 25-4. The front input bore 25-3 is cut into ridges and ridge gap enlarged at 25-3A and 25-3B and the under surfaces of ridges at the front are also cut in at 25-6 to improve the impedance matching of the ports 22 and 23 to the waveguide (see FIGS. 7 and 9).

The device of FIGS. 1–12 may be modified by the addition of a conventional unbalance indicator (power detector) in the load 24 arm. Thus when the tee device is used as a combiner (different input signals to ports 22 and 23 and port 21 serving as the output port) or as a splitter, any unbalanced power would be directed to the load arm (i.e. where the power absorbing load is positioned) and the unbalance indicator would be used to detect this power and provide a measure of the degree of unbalance to detect a fault in external devices providing or receiving power.

FIGS. 13 to 16 represent an alternate embodiment of the invention. In particular, the device 30 comprises input port 31 and two output ports 32 and 33. The input center conductor is shown at 31-1 and includes transformer transitions 31-2 which couple it to output conductors 32-1 and 33-1 for ports 32 and 33. The input center conductor is positioned in the center of a double ridge waveguide 34 of the type shown in FIGS. 1 to 10. Load material 35 is placed about conductor 31-1 at the T junction (See FIG. 16) and a shorting plate 36 which also acts as the rear cover is placed at a distance past the junction and is adjusted for the best VSWR (voltage standing wave ratio) match.

Figure 12:
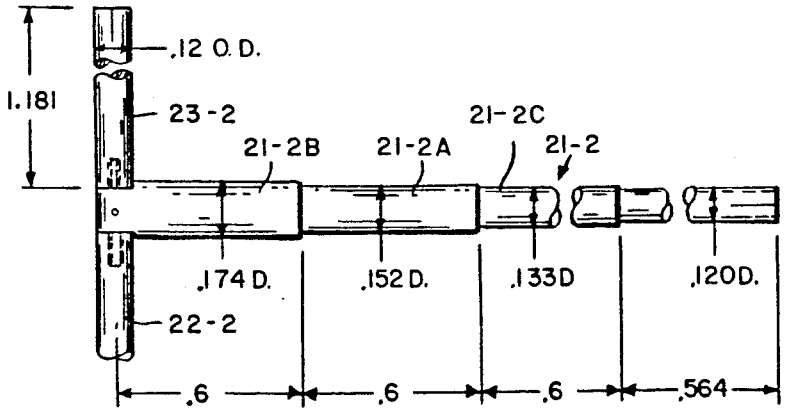
FIG. 12 is a top view of a portion of the T conductor.

As shown, the double ridged waveguide is formed of the four parts which may be of e.g., aluminum. However, as is conventional, the shell (body) may be one or multiple parts joined together or the waveguide may be formed in any other conventional manner. In addition, the conductor 31-1 is positioned through an opening 30-2 in the front end of the waveguide and output conductors 32-1 and 33-1 which together form a single unitary conductor extend through ridged waveguide side walls 34-1 and 34-2 respectively for coupling to the respective connectors. The conductors 31-1, 32-1 and 33-1 are supported in the connections by dielectric material 38 as shown. The conductor 31-1 is coupled to conductors 32-1 and 33-1 to form the T by screws (not shown) and solder (the same configuration as shown in FIG. 12 for the conductors 21-2, 22-2 and 23-2). The load material for dissipating power may be any of the conventional types such as ceramic or epoxy filled with carbonyl iron particles. The tee device of this disclosure is quite acceptable at frequencies of between e.g., 1 to 20 GHz and can provide bandwidths of 3:1 or wider. The devices herein may be air cooled by the uses of fins or cooled by fluid as is conventional.

The tee device described herein is designed to divide wide bandwidth high power signals so that the waveguide load port absorbs any power reflected from output ports and so that those output ports are isolated from each other. The structure is planar in that all four ports (the loaded portion of the waveguide being the fourth port) are in a horizontal plane unlike the conventional magic tee. Furthermore, when the device is operated as a combiner, the device is designed to pass any unbalanced signal to the waveguide load and thus keep the two colinear ports isolated from each other.

The embodiment of the invention described in FIGS. 1–12 includes a load providing internal termination for the fourth port of this magic tee device and an end cover 20-2. The fourth port can be provided as an external port either as ridged waveguide or with a coaxial port through the addition of a coax to waveguide transition by removal of the load 24 and end cover 20-2. When constructed in this manner, the device can be used to interconnect two inputs and two outputs while maintaining isolation between outputs and between inputs. Thus, two power sources can be independently connected to the inputs i.e., 21 and the fourth port (serving as an input) and ports 22 and 23 in this case act as output ports or alternatively ports 22 and 23 can act as input ports with output ports being port 21 and waveguide without endplate 20-2 and without load acting as the fourth port. This is commonly done in dual mode systems where two separate transmitters are simultaneously connected to a pair of antennas without the transmitters affecting each others performance.

Figure 10:
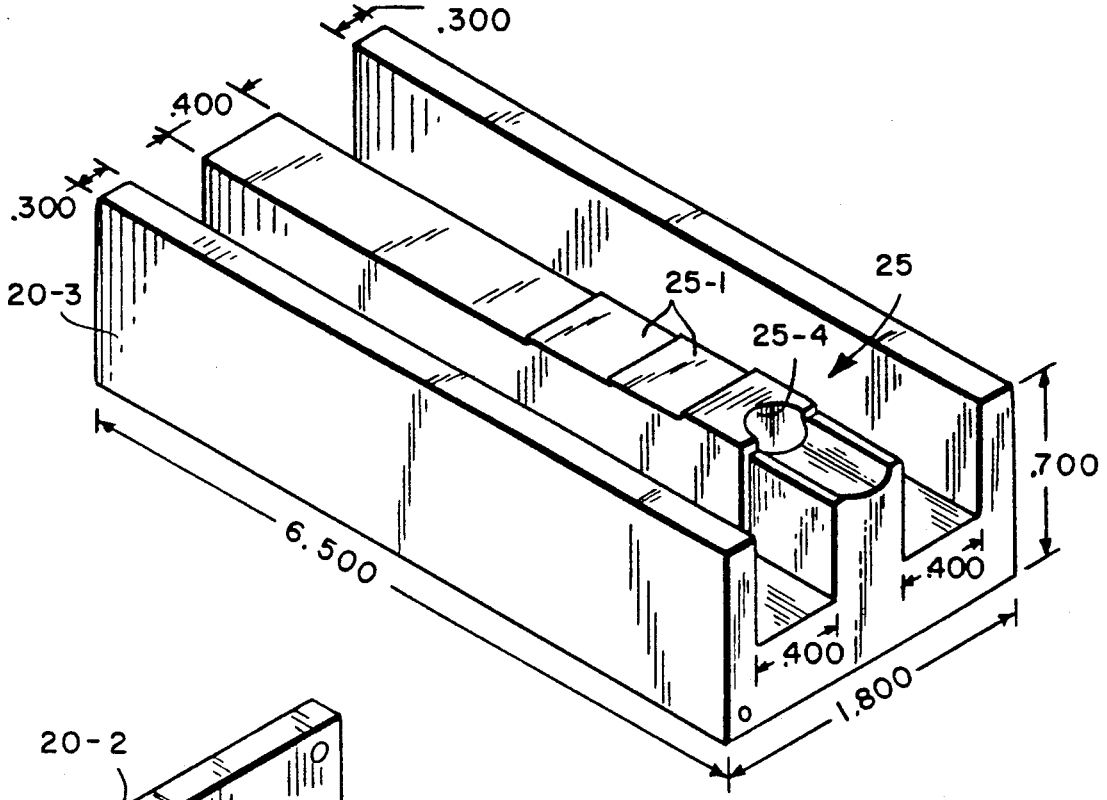
FIG. 10 is an enlarged isometric view showing the waveguide side half without the load.
Figure 11:
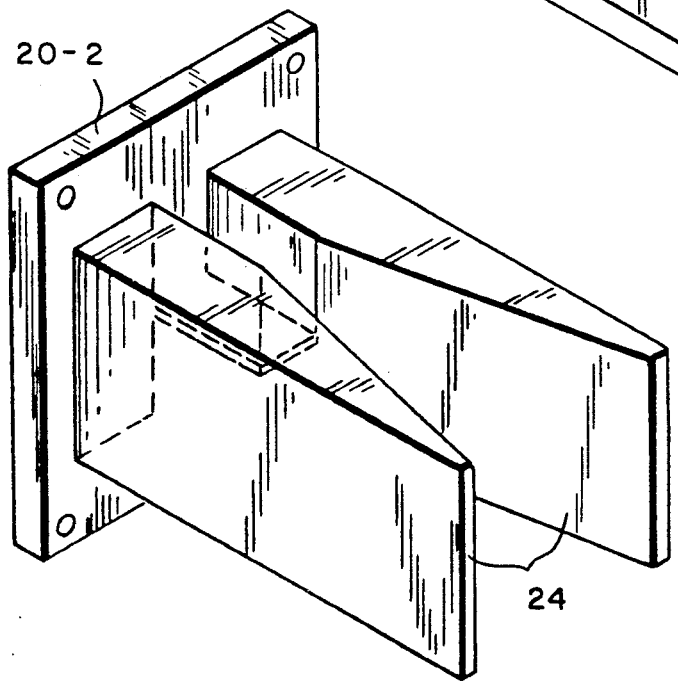
FIG. 11 is an isometric view showing the load attached to the rear end of the waveguide.
Figure 13:
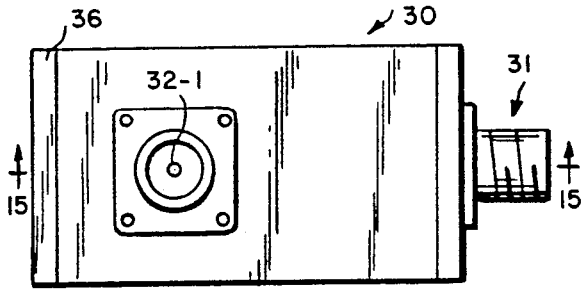
FIG. 13 is a side plan view of an alternate embodiment of the magic tee device of the invention from a perspective showing one input port and one of two output ports.
Figure 14:
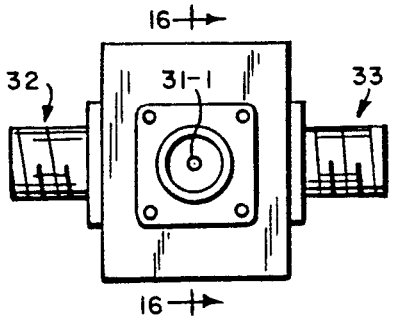
FIG. 14 is a right end view of the device of the invention.
Figure 15:
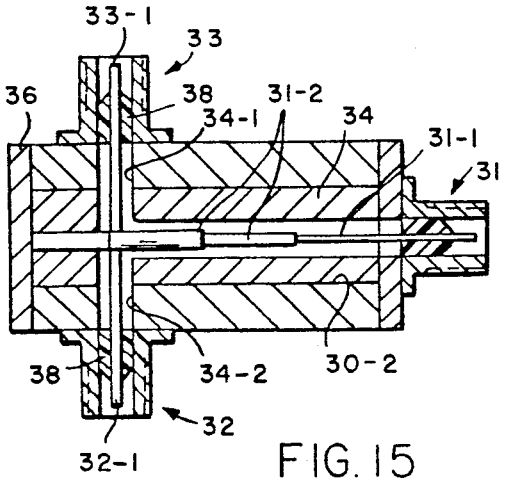
FIG. 15 is a sectional view taken along line 15—15 in FIG. 13.
Figure 16:
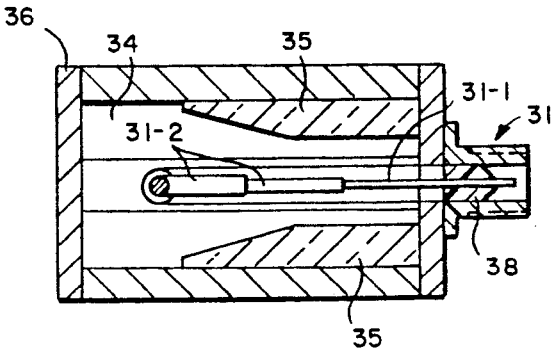
FIG. 16 is a sectional view taken along line 16—16 in FIG. 14.

While those skilled in the art would know how to calculate the dimensions of the tee herein for various frequencies, an example of dimensions in inches are shown in FIG. 10 for one-half of the ridged waveguide and in FIG. 12 for the conductors suitable for use in a device capable of operating at a frequency of 2.5 to 7.5 GHz. It should also be understood that the conductors 22-2 and 23-2 may be one piece which is then joined to the conductor 21-2 rather than three separate pieces as shown.

I claim:

1. A coaxial planar magic tee device comprising a first center conductor and second and third center conductors joined together to form a T with the second and third conductors forming the horizontal top of the T and the first conductor forming the vertical leg of the T, a double ridged waveguide having ridged side walls, said first conductor positioned in the center of said double ridged waveguide with the junction of said first, second and third conductors within said waveguide, said second and third conductors extending through side ridged walls of said waveguide, and a load within said waveguide to dissipate power, said load positioned away from said junction, and in which said load is positioned in said waveguide about said first center conductor and in which a shorting plate is positioned within the waveguide and away from said second and third conductors and opposite said first conductor.

2. A coaxial planar magic tee comprising an outer shell defining a double ridged waveguide and two colinear openings through opposite ridged side walls of said ridged waveguide, an orthogonal opening through a front end of said waveguide, coaxial connectors coupled to each of said openings, a first center conductor positioned between the ridges of said waveguide, second and third center conductors positioned in the openings of the waveguide side walls and extending into the area between said ridges and coupled to said first conductor to form a T junction within the confines of the waveguide, the ends of said conductors forming the center conductors of said connectors and a power absorbing load positioned in said waveguide between said second and third conductors' junction with said first conductor and the rear, closed end of said waveguide.

3. A coaxial planar magic tee comprising a double ridged waveguide having a front wall and opposite side ridged walls, an opening in the front wall thereof and two colinear openings in said opposite side ridged walls thereof, a shorting plate at the opposite end of the waveguide to the front end opening thereof, a first conductor positioned in the front end opening and joined to second and third conductors at one of its ends to form a T junction within the waveguide, said second and third conductors having respective portions positioned in said respective side wall openings, and a load positioned about said first conductor and away from said T junction.

* * * * *